US010433656B2

(12) United States Patent
Lundh

(10) Patent No.: US 10,433,656 B2
(45) Date of Patent: Oct. 8, 2019

(54) BABY CARRIER

(71) Applicant: Joran Lundh, Hong Kong (CN)

(72) Inventor: Joran Lundh, Hong Kong (CN)

( * ) Notice: Subject to any disclaimer, the term of this patent is extended or adjusted under 35 U.S.C. 154(b) by 0 days.

(21) Appl. No.: 15/741,991

(22) PCT Filed: Jul. 15, 2016

(86) PCT No.: PCT/EP2016/066889

§ 371 (c)(1),
(2) Date: Jan. 4, 2018

(87) PCT Pub. No.: WO2017/013008

PCT Pub. Date: Jan. 26, 2017

(65) Prior Publication Data

US 2018/0199730 A1 Jul. 19, 2018

(30) Foreign Application Priority Data

Jul. 17, 2015 (SE) ..... 1551028

(51) Int. Cl.
*A47D 13/02* (2006.01)
*A45F 3/04* (2006.01)

(52) U.S. Cl.
CPC ..... *A47D 13/025* (2013.01); *A45F 3/047* (2013.01); *A45F 2003/045* (2013.01)

(58) Field of Classification Search
CPC ..... A47D 13/025
USPC ..... 224/158–161; 24/382, 436
See application file for complete search history.

(56) References Cited

U.S. PATENT DOCUMENTS

D692,227 S * 10/2013 Andren ..... D3/213
9,788,664 B2 * 10/2017 Andren ..... A47D 13/025
2013/0232736 A1 * 9/2013 Sato ..... A44B 19/28 24/382
2015/0115003 A1 * 4/2015 Schaarschmidt .... A47D 13/025 224/160

FOREIGN PATENT DOCUMENTS

DE 202012006709 U1 8/2012
EP 2491825 A2 8/2012
JP 2013085567 A * 5/2013 ..... A47D 13/025
WO 2009034233 A1 3/2009

(Continued)

OTHER PUBLICATIONS

English Translation of JP 2013085567 from Espacenet, accessed on Feb. 25, 2019.*

(Continued)

*Primary Examiner* — Scott T McNurlen
(74) *Attorney, Agent, or Firm* — Sandberg Phoenix & von Gontard PC

(57) ABSTRACT

A baby carrier is provided which has a front portion (101), a stomach portion, two shoulder straps (103*a*, 103*b*), each having a first and a second end portion, and a waist strap (102). The first end portion of each shoulder strap (103*a*, 103*b*) is fixedly attached to the stomach portion and the second end portion is attached to the front portion (101). The front portion (101) and stomach portion are attached to the waist strap (102) in such a way that the stomach portion and front portion are at least partly detachable from the waist strap (102). This provides the baby carrier with support means for a child's legs when sitting in a forward position.

16 Claims, 10 Drawing Sheets

(56) References Cited

FOREIGN PATENT DOCUMENTS

| | | | |
|---|---|---|---|
| WO | 2010123446 | A1 | 10/2010 |
| WO | 2014011102 | A1 | 1/2014 |
| WO | 2015053696 | A1 | 4/2015 |

OTHER PUBLICATIONS

International Search Report for corresponding PCT/EP2016/066889 dated Oct. 12, 2016.
Written Opinion for corresponding PCT/EP2016/066889 dated Oct. 12, 2016.

* cited by examiner

BABY CARRIER

CROSS-REFERENCE TO RELATED APPLICATIONS

This application is the US National Stage under 35 U.S.C. § 371 of International App. No. PCT/EP2016/066889 filed on Jul. 15, 2016, and which claims priority to Swedish App. No. 1551028-2 filed on Jul. 17, 2015, both of which are incorporated herein by reference.

TECHNICAL FIELD

The present invention relates to a carrying harness, primarily designed for carrying a small child, in either a forward or a backward position, against the carrier's chest and stomach.

BACKGROUND

Humans have been carrying our children through all ages, on our backs or towards our chest. Previously, the child was often carried in a simple piece of cloth, but nowadays many parents choose to use a so called baby carrier in order to carry their child close to themselves, and at the same time have their hands free. Since many children like to be carried, they tend to sit in the carrier for long periods of time, meaning that the ergonomics for both child and carrying person is important.

EP2491825A2 describes a child carrier which comprises inserts by which the width of the seating area of the carrier can be modified when the child is placed in a backwards-facing position. The wider seating area is supposed to promote a more ergonomic seating position for the child, but a drawback with this carrier is that the insert is a detachable part, which is easily lost. Further, this insert can only be used when the child is sitting in a rearward-facing position.

WO2015/053696A1 describes a baby carrier with an adjustable seat height. This baby carrier is made for children being carried face-to-face with the carrier, and with the adjustable seat height it can be used also when the child has grown. A drawback with this carrier is that it does not allow the child to be carried in a forward position.

WO2014/011102A1 discloses another type of baby carrier which is mentioned here as a further example of background art. A drawback with this baby carrier is that it is not possible to carry the child in a forward facing seating position.

From the above it is understood that there is room for improvement.

SUMMARY

An object of the present invention is to provide a new type of baby carrier which is improved over prior art and which eliminates or at least mitigates the drawbacks discussed above. More specifically, an object of the invention is to provide a baby carrier that provides the child with a comfortable and ergonomic seating position both when carried forwards as well as backwards. These objects are achieved by the technique set forth in the appended independent claims with preferred embodiments defined in the dependent claims related thereto.

In a first aspect, a baby carrier is provided, which has a front portion, a stomach portion, two shoulder straps, each having a first and a second end portion, and a waist strap. The first end portion of each shoulder strap is fixedly attached to the stomach portion and the second end portion is attached to the front portion. The front portion and stomach portion are attached to the waist strap in such a way that the stomach portion and front portion are at least partly detachably attached to the waist strap. This baby carrier is advantageous in that the connection between the stomach portion and the waist strap is adjustable by being partly detachable. It provides the carrier with flexibility and seating options which existing carriers do not have.

In one embodiment, a middle portion along both the front portion and stomach portion is fixedly attached to the waist strap, and two side portions, along both the front portion and stomach portion, one on each side of the middle portion, are detachably attached to the waist strap. This is advantageous since it provides the baby carrier with flexibility since the width of the seating area, and the angle of the side portions can be modified.

In one embodiment, the side portions are attached to the waist strap by zippers which are openable by one of a one-step maneuver by means of a common drawstring or two separate zipper pullers. When carrying a child there is a lot to keep track of: holding the child, adjusting his position in the carrier, comforting him etc., it is thus very desirable to be able to maneuver the zippers by one hand only. It is also desirable to operate the zippers by means of separate zipper pullers, since it is an inexpensive and robust design.

The side portions may be connected to the waist strap by one of the following fastening means: zippers, buttons, Velcro, press studs or hooks. These fastening means provides the side portions with a secure, but easy maneuverable connection.

In one embodiment, the intersection in which the front portion and stomach portion are connected to the waist strap comprises a zipper which is openable from two directions. This is advantageous in the production of the baby carrier, since it is easy to attach one single zipper. It is thus more cost efficient, both according to the work spent attaching it and also in that one zipper, although longer, is less expensive than two shorter zippers.

In another embodiment, the zipper comprises two stops such that the opening is limited to along two side portions of both the front portion and stomach portion.

Preferably, the baby carrier has a bottom portion fixedly attached to the front portion and detachably attached to the stomach portion, such that it is movable between at least two positions. A first position of the bottom portion is a low position in which said bottom portion follows the outline of a lower part of the front portion and a lower part of the stomach portion. A second position of the bottom portion is a high position in which a distance is provided between the bottom portion and the front portion and stomach portion. The adjustable bottom portion provides the carrier with the flexibility to carry both older (larger) or younger (smaller) children, without compromising with their comfort.

In one embodiment, the carrier has two interstitial straps, each of which has a first end section and a second end section. The first end sections are stitched to the front portion and the second end sections are detachably connected to the shoulder straps. This strap is beneficial for the stability of the baby carrier.

In a second aspect, a method for adjusting a baby carrier from a backward seating position into a forward seating position is provided. In the method, zipper(s) is(are) opened, such that two side portions of the front portion and stomach portion are disengaged from the waist strap, providing the baby carrier with support means for a child's legs when sitting in a forward position. Since it is recommended by pediatricians that carried children sit in the so-called frog-position, in which their upper legs are substantially parallel with the ground, and their knees at substantially the same level as their hips, it is advantageous for a baby carrier to provide this seating option.

In one embodiment, the zipper(s) is(are) operated by means of a common drawstring. This is advantageous in that the carrier may be transformed from a backwards seating position into a forward seating position in one operation. This is valuable for parents who often need to carry many things in their hands.

In another embodiment, the zipper(s) is(are) operated by means of two separate zipper pullers. This is advantageous in that the opening/closing is uncomplicated and cheap, as well as a robust structure.

BRIEF DESCRIPTION OF THE DRAWINGS

Embodiments of the child carrier will be described in the following; references being made to the appended diagrammatical drawings which illustrate non-limiting examples of how the inventive concept can be reduced into practice.

DETAILED DESCRIPTION

Figure 1:
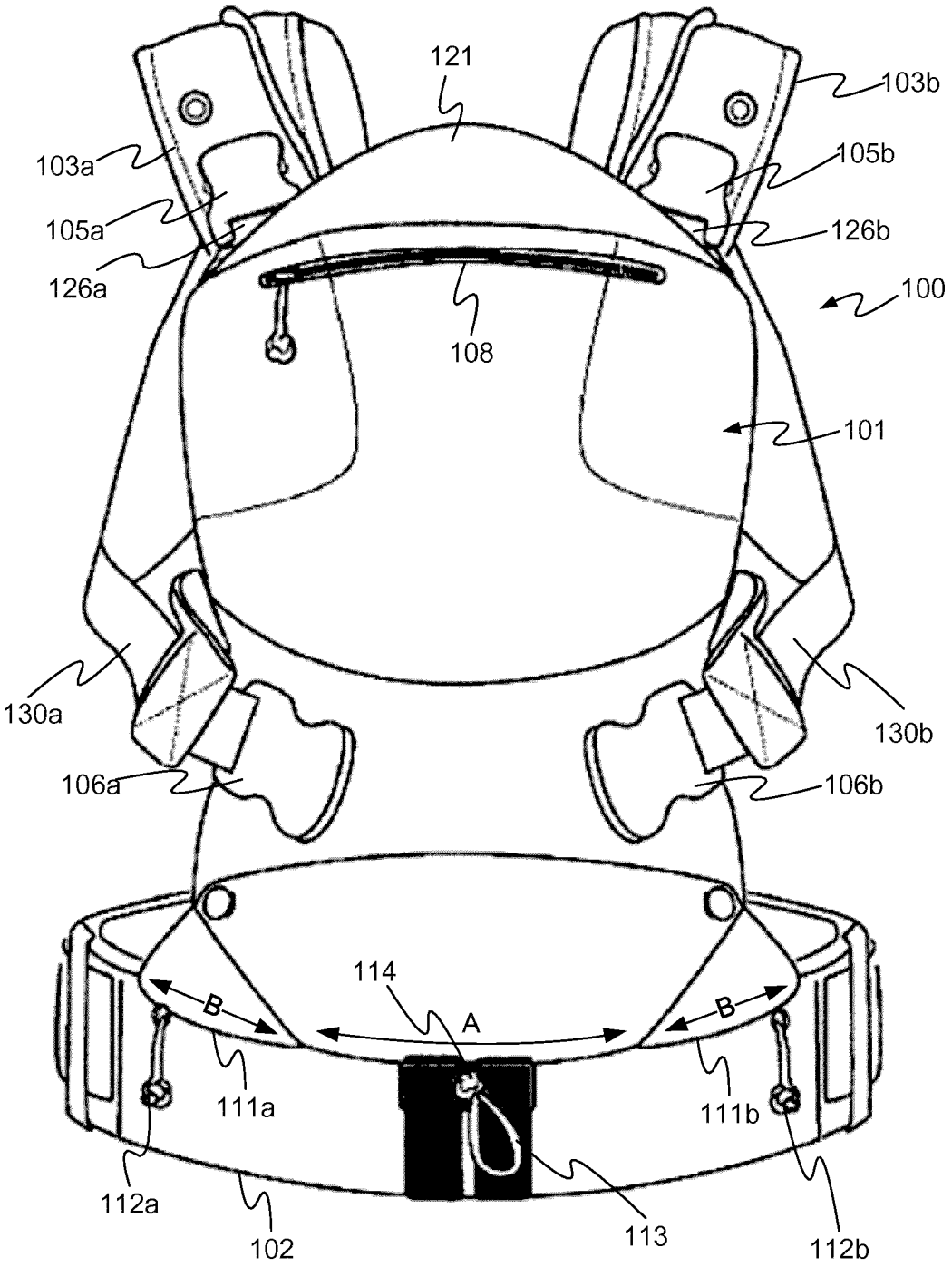
FIG. 1 is a front view of a baby carrier shown in a backwards seating position.
Figure 2:
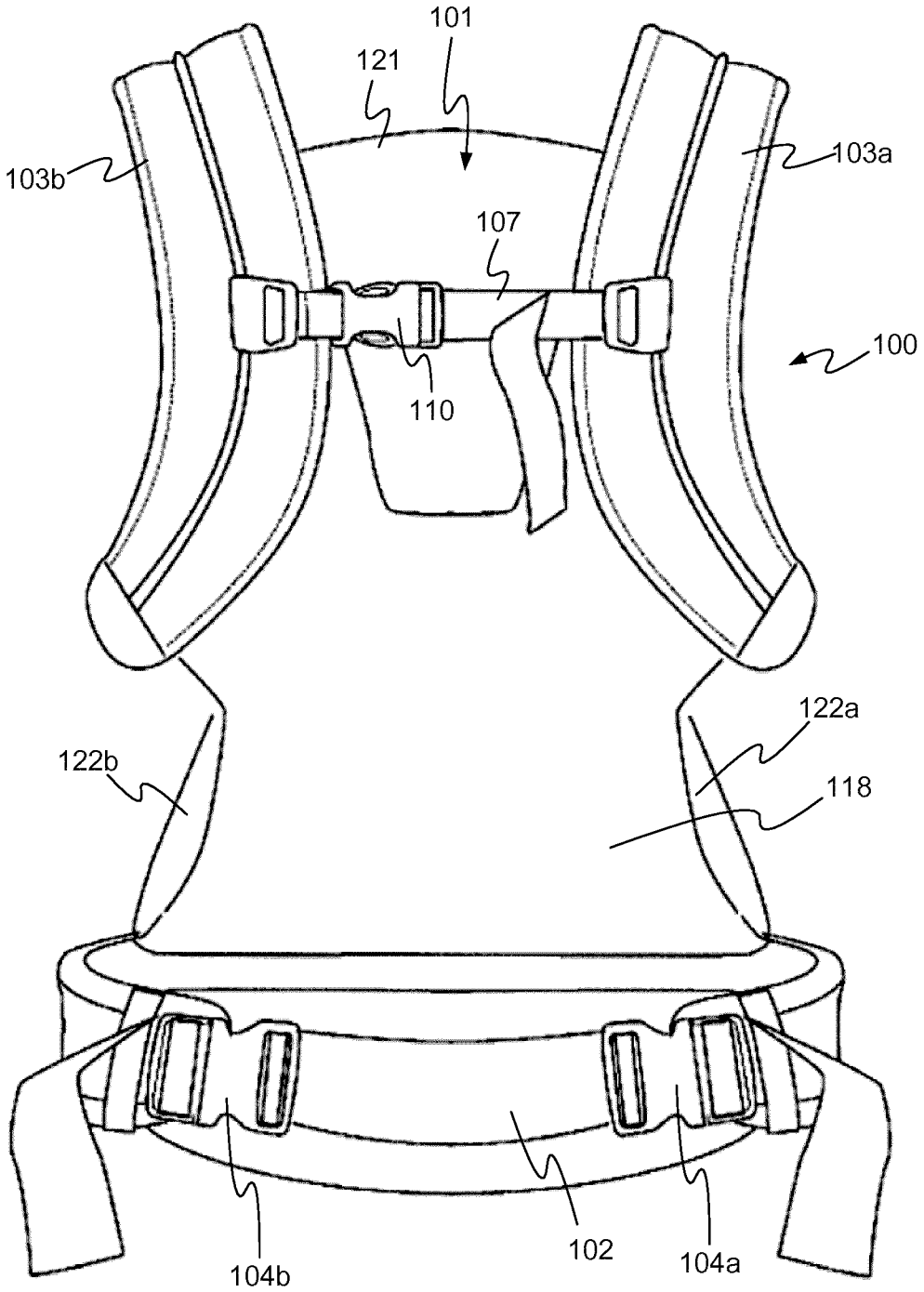
FIG. 2 is a back view of the baby carrier in a backwards seating position.

Hereinafter, certain embodiments will be described more fully with reference to the accompanying drawings. The invention may, however, be embodied in many different forms and should not be construed as limited to the embodiments set forth herein; rather, these embodiments are provided by way of example so that this disclosure will be thorough and complete, and will fully convey the scope of the invention, such as it is defined in the appended claims, to those skilled in the art.

In FIGS. 1-4, a baby carrier 100 is shown in a position for a child to sit backwards, that is face-to-face with the carrying person. The carrier 100 has a front portion 101, a stomach portion 118, a waist strap 102 and two shoulder straps 103*a*, 103*b*. It also has a bottom portion 109 which will be explained in more detail in connection with FIGS. 5-6. A first end 129*a*, 129*b* of each shoulder strap 103*a*, 103*b* is attached to an upper part of the stomach portion 118, and a second end portion 130*a*, 130*b* is releasably attached to a middle part of the front portion 101 by buckles 106*a*, 106*b*. The front portion is further connected to the shoulder straps 103*a*, 103*b* by means of interstitial straps 126*a*, 126*b*. Each interstitial strap has a first end section 127*a*, 127*b* and a second end section 128*a*, 128*b*. The first end sections 127*a*, 127*b* are stitched to the front portion 101 and the second end sections are detachably attached to the shoulder straps 103*a*, 103*b* by buckles 105*a*, 105*b*. The two shoulder straps 103*a*, 103*b* are interconnected by an intermediate strap 107 which can be released by a buckle 110.

The waist strap 102 is openable in two locations by buckles 104*a*, 104*b*. As an option, the waist strap 102 is only openable in one location. A front part of the waist strap 102 is attached to a lower part of the front portion 101 as well as to a lower part of the stomach portion 118 along an interface A, B. A middle portion A of the interface between the front portion 101, stomach portion 118 and the waist strap 102 is sewn or stitched; it is thus not releasable. Two end portions B of the interface, however, are provided with zippers 111*a*, 111*b*, the function of which will be described later. The zippers 111*a*, 111*b* are arranged inside a fold of fabric when in a closed state, and behind a rim 125 of fabric in an undone state such that they do not irritate or harm either the carrying person or the child. The sliders (not shown) of the zippers 111*a*, 111*b* are, in one embodiment, each connected to an individual drawstring 112*a*, 112*b*, as well as to a common drawstrings 113. The common drawstring 113 extends from the slider of each zipper 111*a*, 111*b* and within the fabric of the front portion 101 until it protrudes via an opening 114 at the center of the waistband 102. In another embodiment (not shown), the zippers are operated by means of the individual sliders, or pullers, only.

All embodiments of the baby carrier described herein have a stitched portion A and two detachable portions B, but it would also be possible that the interface A, B is provided by two zippers which meet in the middle. In this additional embodiment the front portion 101 and stomach portion 118 are completely detachable from the waist strap 102. This could be beneficial for example when donning the carrier 100.

The zippers 111*a*, 111*b* are in one embodiment attached to the waist strap 102 and the front portion 101, in another embodiment they are attached to the waist strap 102 and the stomach portion 118, and as a further option, it may be attached to the stitching between the front portion 101 and stomach portion 118.

In an alternative embodiment, the front and stomach portions comprise one integral piece (not shown) and the zippers 111*a*, 111*b* are attached to the waist strap 102 and to this integral piece. In yet another embodiment, an intermediate portion (not shown) is stitched to the waist strap 102. The zippers 111*a*, 111*b* connect in this embodiment the intermediate portion to the front-/stomach portions. It may also be the other way around, i.e. the intermediate portion is stitched to the front-/stomach portions and the zippers connect the intermediate portion to the waist strap. The purpose of the zippers 111*a*, 111*b* is to disconnect at least a part of both the front portion and the stomach portion from the waist strap. The stomach portion 118 and the front portion 101 are thus at least partly disengageable from the waist strap 102.

Further, the baby carrier 100 has a pocket 108 in the front portion 101, which is closed with a zipper. This will be described in more detail in connection with FIGS. 10 and 11.

Figure 3:
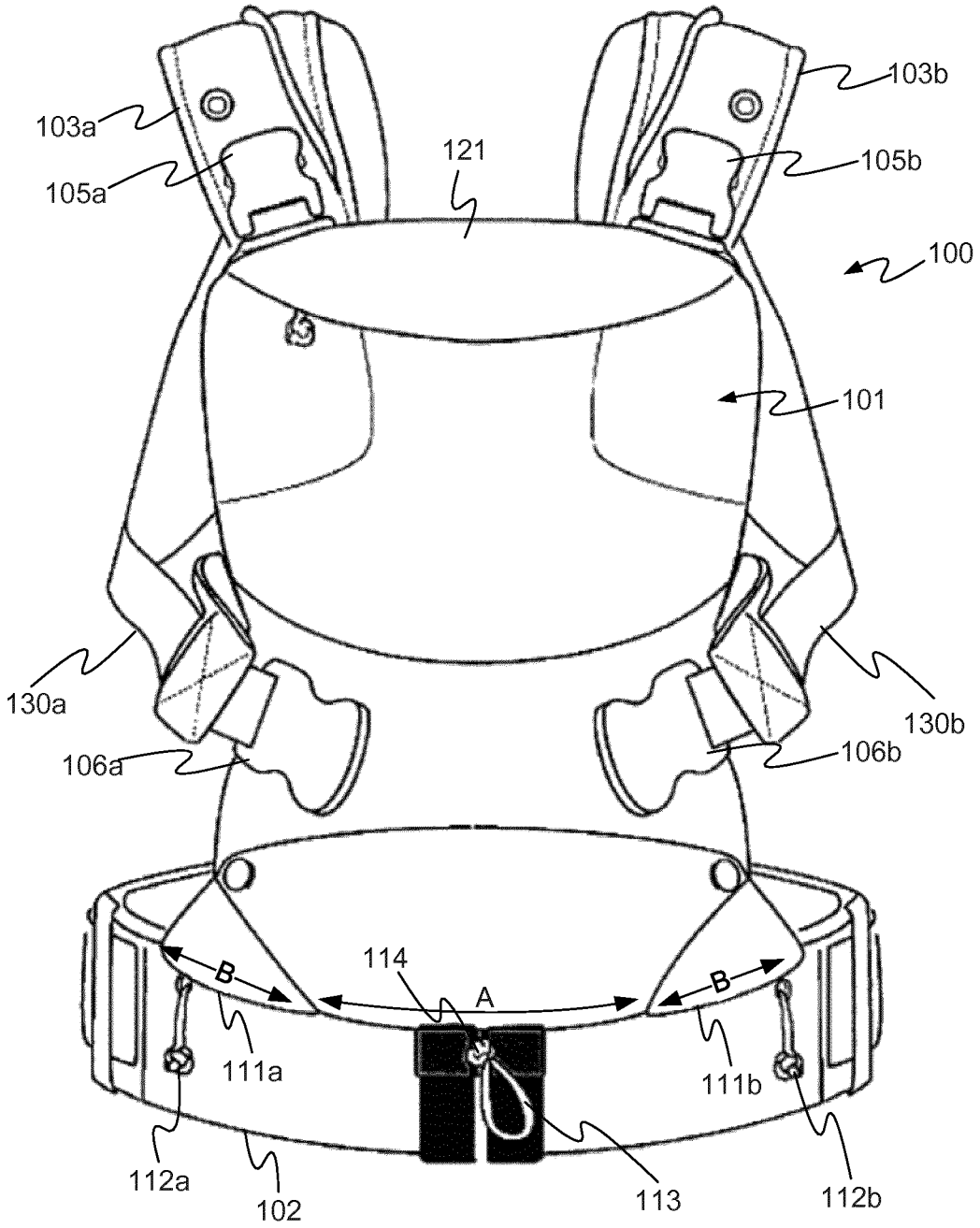
FIG. 3 is a front view of the baby carrier in the backwards seating position with a folded front portion.
Figure 7:
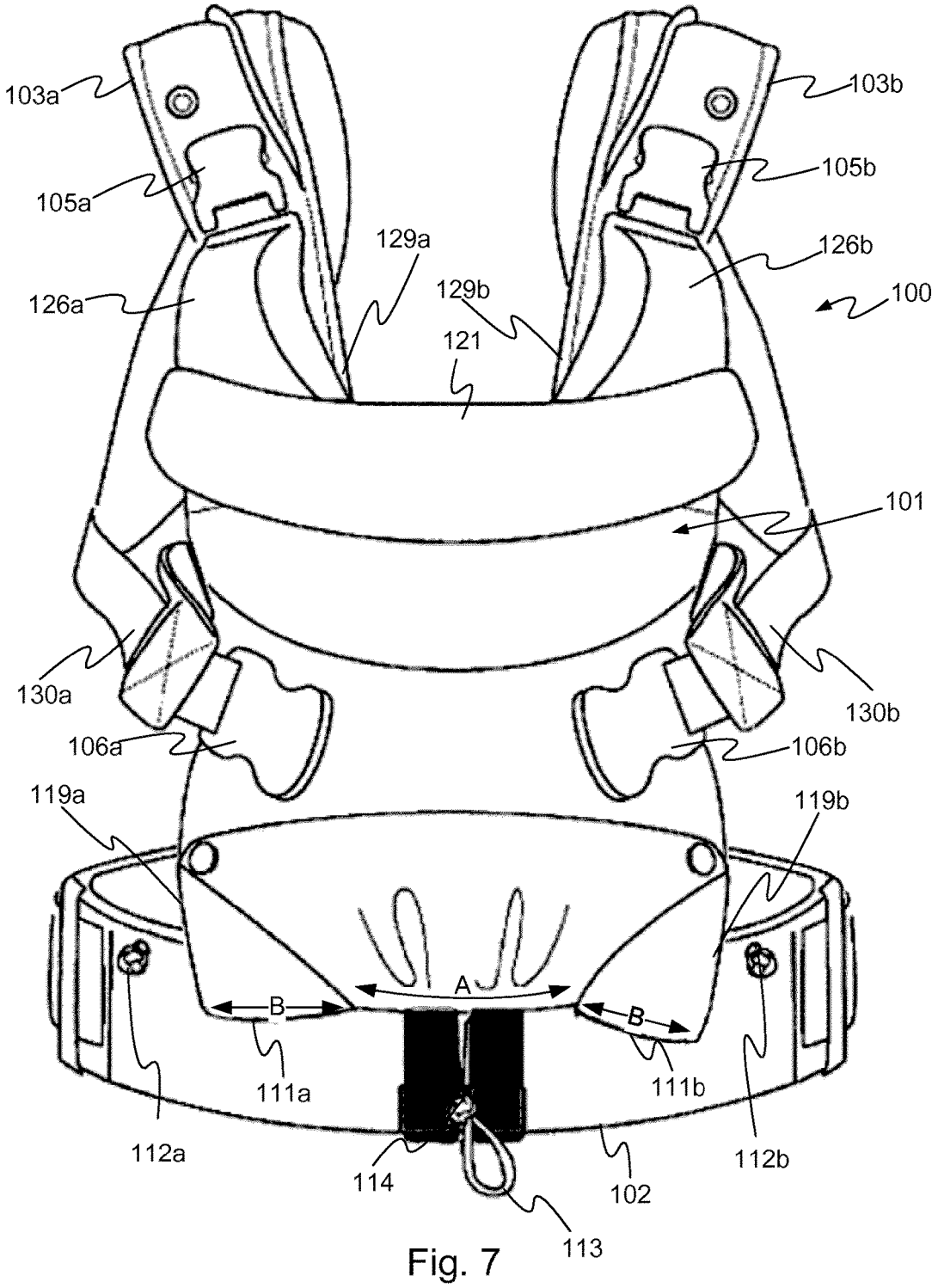
FIG. 7 is a front view of the baby carrier in a forwards seating position.

An upper part 121 of the front portion 101 is foldable into at least two positions. In a first position, as shown e.g. in FIG. 1, the upper part 121 is raised and provides support for the child's head. In FIG. 3 the upper part 121 is partly lowered, such that the child's head becomes freer. This position of the upper part 121 could be suitable for older children who do not like to feel enclosed by the carrier. A third position of the upper part 121 is shown in FIG. 7, in which it is completely folded down, allowing a child placed in a forward facing position to have his/her face free.

Figure 4:
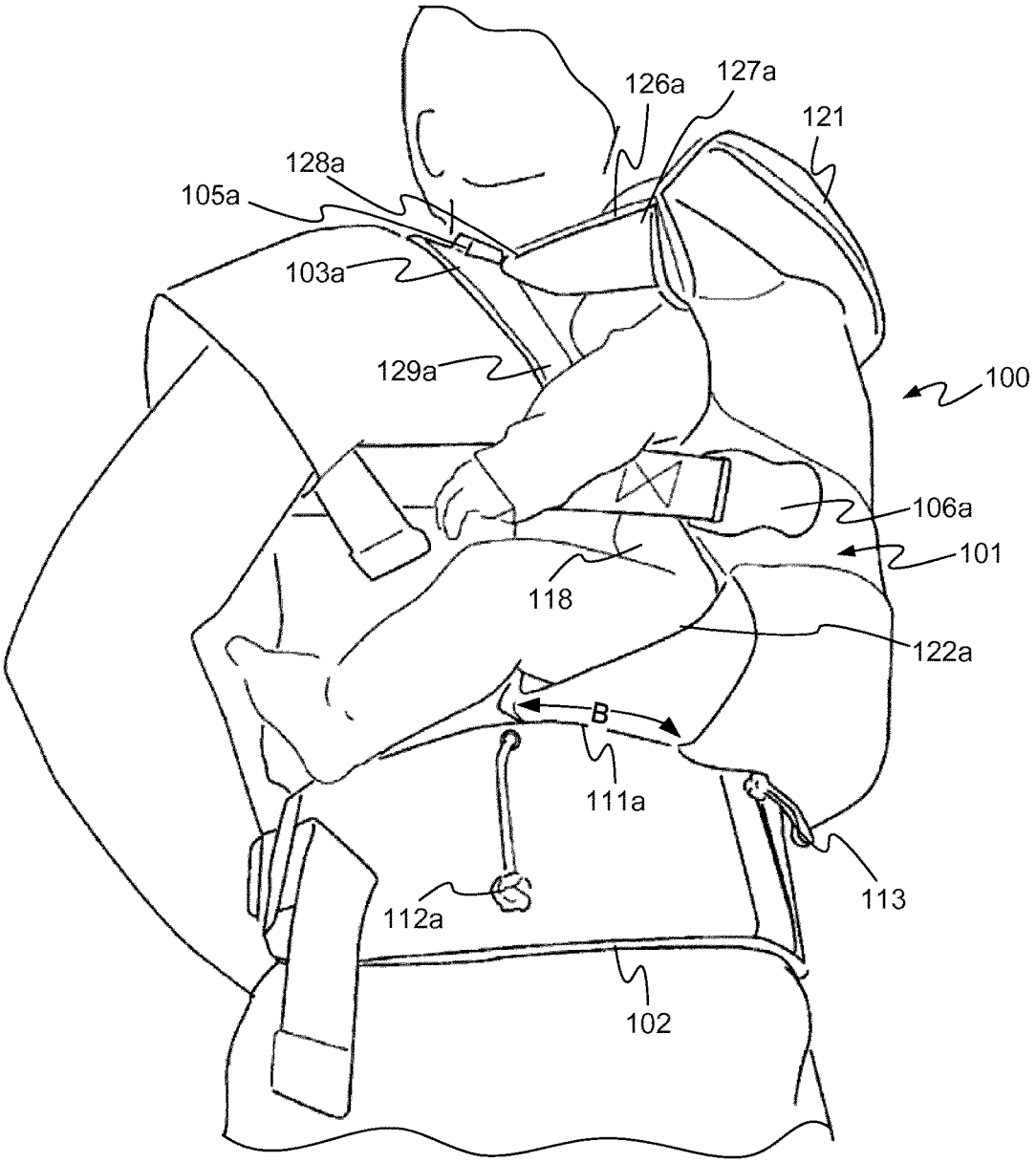
FIG. 4 is an isometric view of the baby carrier in use in the backwards seating position.

In use, which for instance can be seen in FIG. 4, the waist strap 102 encircles the waist, or hips, of a carrying person. The shoulder straps 103*a*, 103*b* extend from the shoulders of the carrier, around his back, and reach the front portion 101 at a level of his chest, where they are releasably attached to the front portion 101 by the buckles 106*a*, 106*b*. The child is placed between the front portion 101 and the stomach portion 118, with his/her legs extending through openings 122*a*, 122*b* formed between the front portion 101 and the stomach portion 118, such that they extend around the carrier's waist, substantially parallel with the waist strap 102. The child's head is supported by the upper part 121 of the front portion 101.

Figure 5:
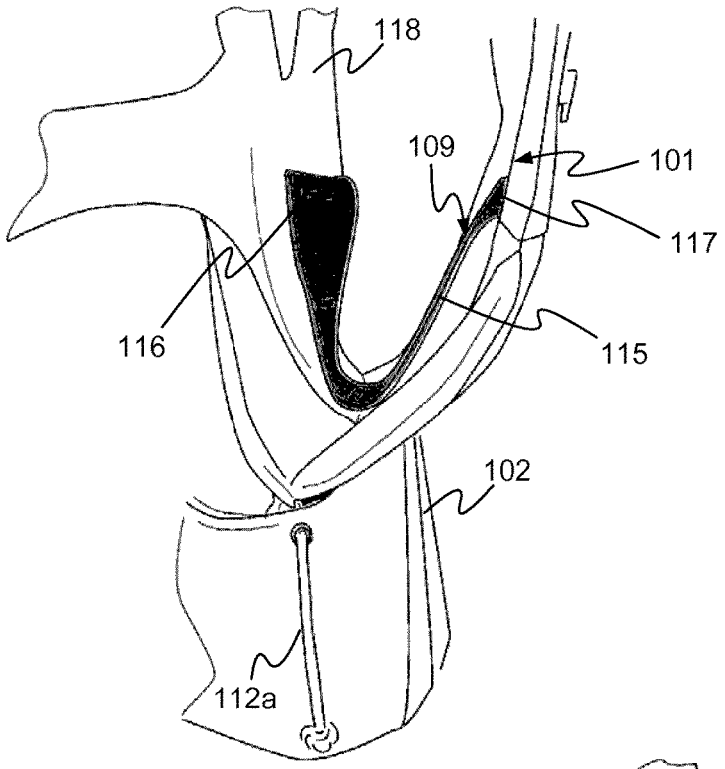
FIG. 5 is an isometric view of a bottom portion of the baby carrier in a low position.
Figure 6:
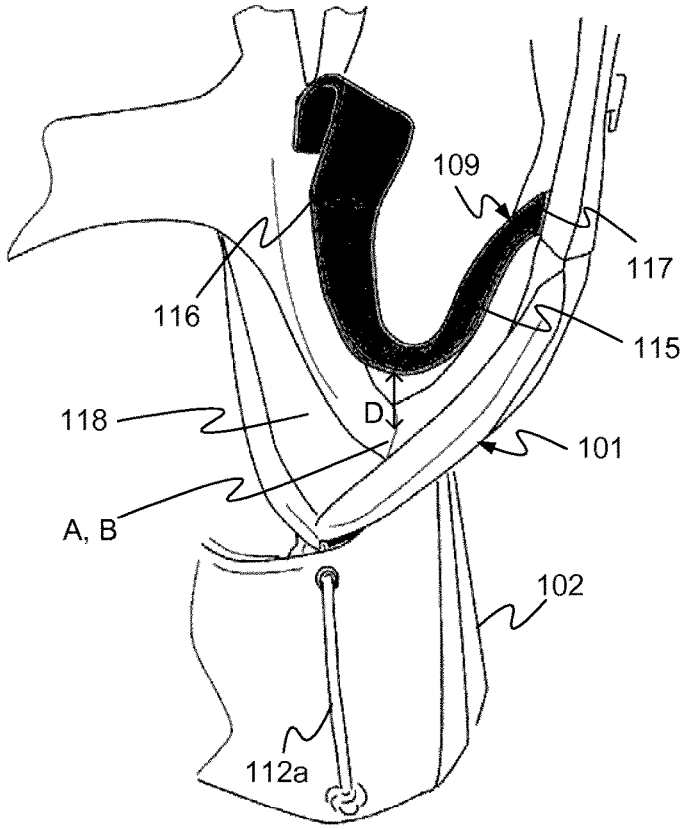
FIG. 6 is an isometric view of the bottom portion of the baby carrier in a high position.

Now referring to FIGS. 5 and 6 where the bottom portion 109 is shown. A first part 115 of the bottom portion 109 is sewn to the front portion 101 by stitching 117. An opposite corresponding part 116 of the bottom portion 109 is detachably attached to the stomach portion 118 by a hook-and-eye-connection. As alternatives, the attachment could instead comprise buttons, a zipper, Velcro fastener, snap fasteners, press studs or any other suitable fastening means. It could also be possible to let the second part 116 of the bottom portion 109 be attached to the stomach portion 118 by stitching and the first part 115 be releasably attached to the front portion 101.

By the releasable second part 116, the height of the bottom portion 109 can be changed between two positions. With the hooks of the second part 116 attached in a first mode, a first, lower position is provided, as shown in FIG. 5, in which the bottom portion 109 follows the outline of a lower part of the front portion 101 and a lower part of the stomach portion 118. In a second, higher position, as shown in FIG. 6, the hooks of the second part 116 are attached in another mode, providing a distance D between the bottom portion 109 and the interface A, B between the front portion 101 and the stomach portion 118. This provides for adaption of the carrier 100 to suit both smaller children, using the higher position, as well as larger children, using the lower seat position.

Figure 8:
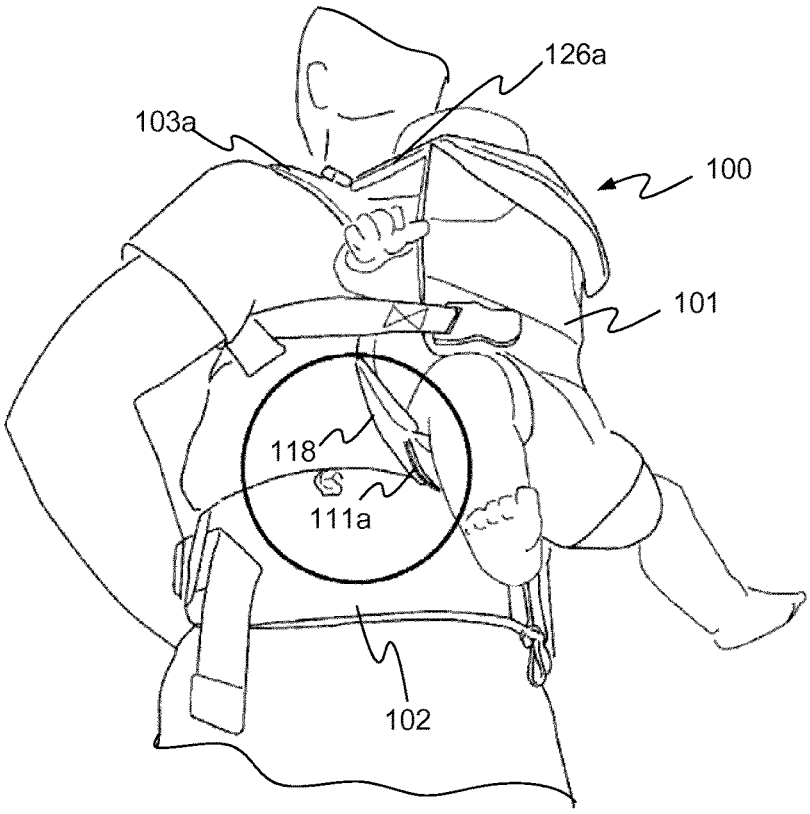
FIG. 8 is an isometric view of the baby carrier in use in the forwards seating position.
Figure 9:
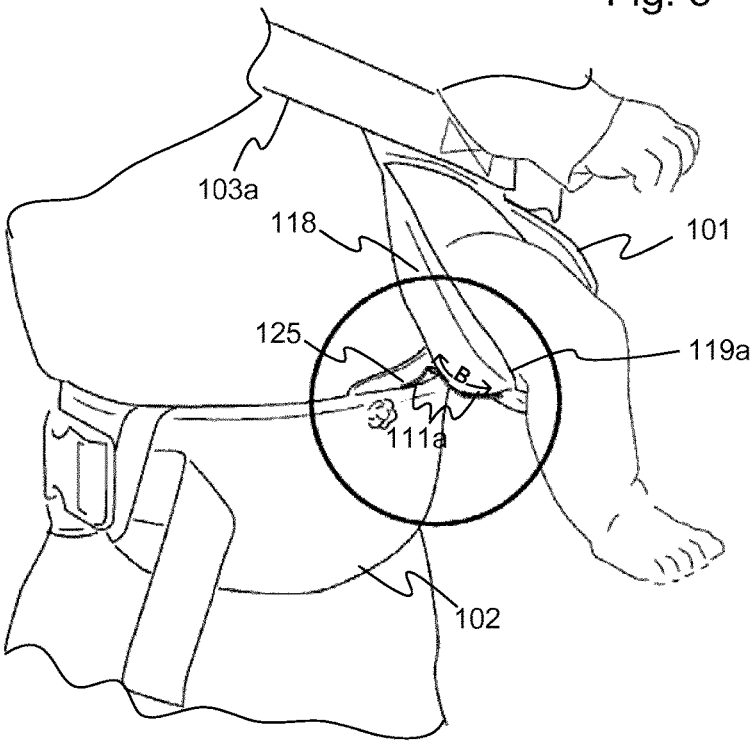
FIG. 9 is an isometric view of the baby carrier in use in the forwards seating position.

In FIGS. 7-9, the baby carrier 100 is adjusted into a position where the child sits in a forward direction, i.e. faces the same direction as the carrying person. In order to adjust the baby carrier 100 from the backwards seating position into this forward seating position the drawstring 113 is pulled. This brings the zippers 111*a*, 111*b* to open, and the two side portions B to disengage from the waist strap 102. The disengaged stomach portion 118 and front portion 101 together form support means 119*a*, 119*b* for the carried child's legs. The child is thus sitting in the so called frog-position also when facing forward.

As is best seen in the circled portions of FIGS. 8-9, the two detachable end parts B of the front portion 101 and stomach portion 118 are disengaged, i.e. the zippers are undone. The disengaged end parts B are folded outwards and the legs of the carried child rest in the support means 119*a*, 119*b* formed by the front portion 101 and the stomach portion 118. In this position of the baby carrier 100, the child is placed between the front portion 101 and the stomach portion 118, but such that the child faces the same direction as the carrying person. The child's legs extend through the openings 122*a*, 122*b* but are now directed forward and downward. Support for the child's legs is provided by the disengaged parts B, meaning that the child is sitting in the so-called frog position also when facing forward. The upper part 121 of the front portion 101 is folded downwards, such that the child's face is free and he/she can look ahead.

Figure 10:
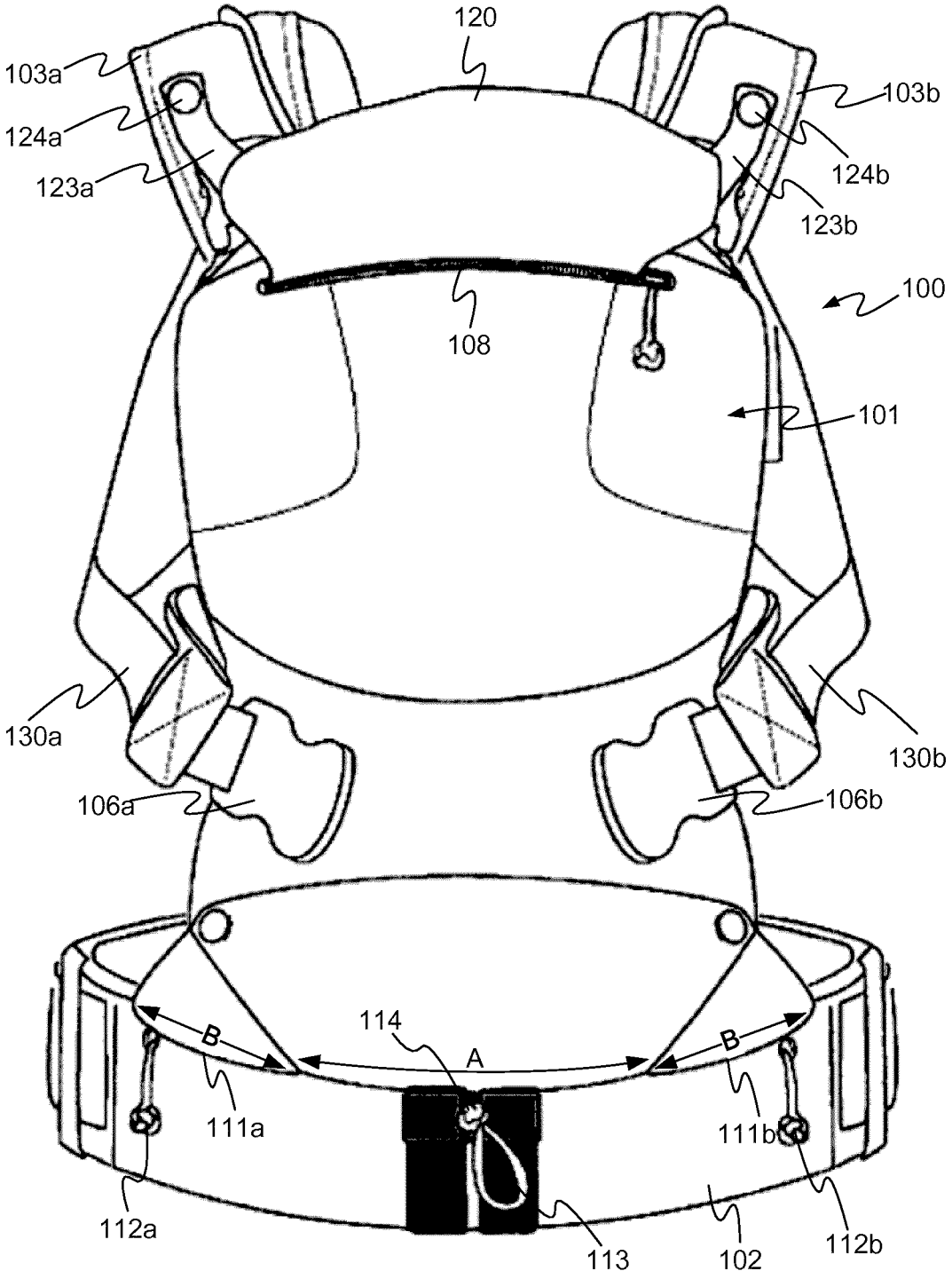
FIG. 10 is a front view of the baby carrier with an unfolded cap.
Figure 11:
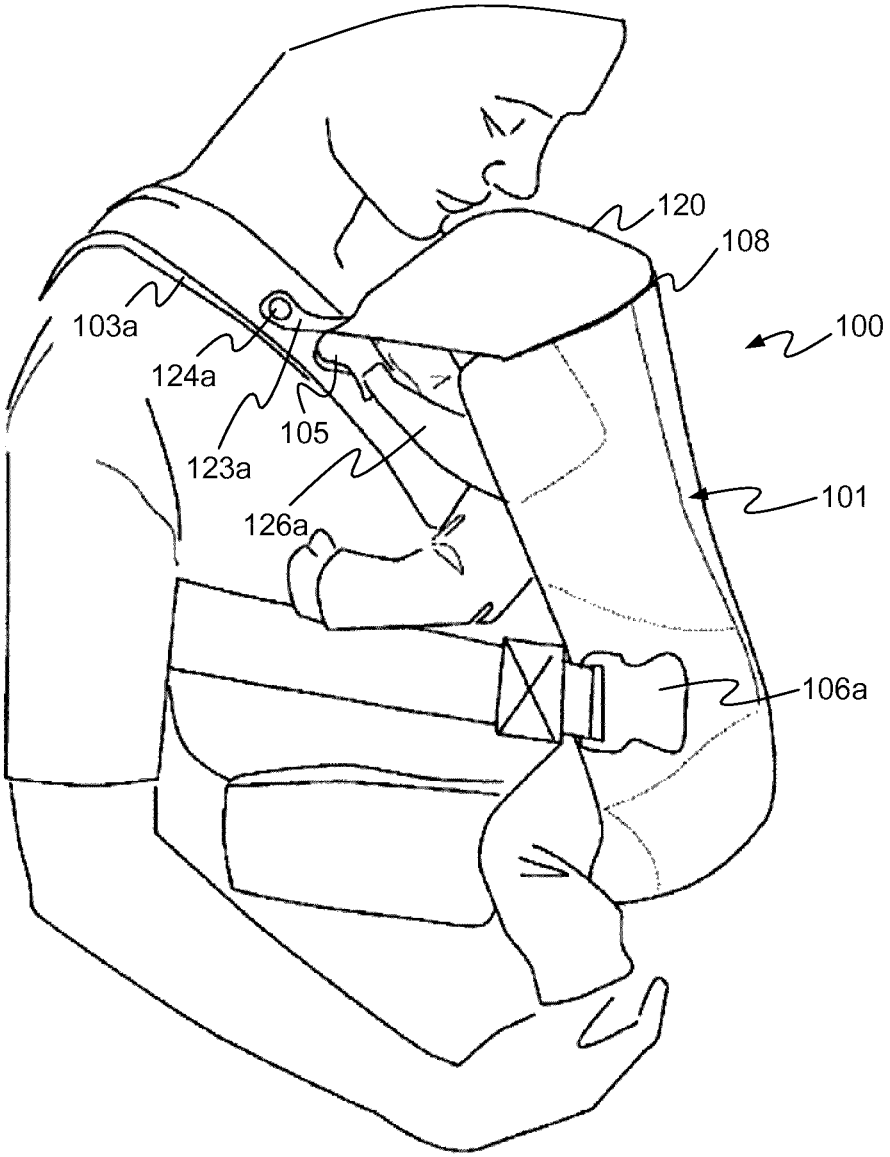
FIG. 11 is an isometric view of the baby carrier in use with the unfolded cap.

Referring to FIGS. 10 and 11, the baby carrier 100 is shown with the pocket 108 opened. This pocket 108 has a foldable cap 120, here shown in its unfolded state. The cap 120 extends from the pocket 108 on the outside of the front portion 101 and towards the carrying person. It has straps 123*a*, 123*b* which are releasably attached to the shoulder straps 103*a*, 103*b* by e.g. press studs 124*a*, 124*b*, or any other suitable fastening means. The cap 120 covers the baby's head in order to protect it from e.g. rain or sunshine. The pocket 108 includes in one embodiment only the cap 120, but in another embodiment it also has space for one or a few other small articles, such as a pacifier or a napkin.

Figure 12:
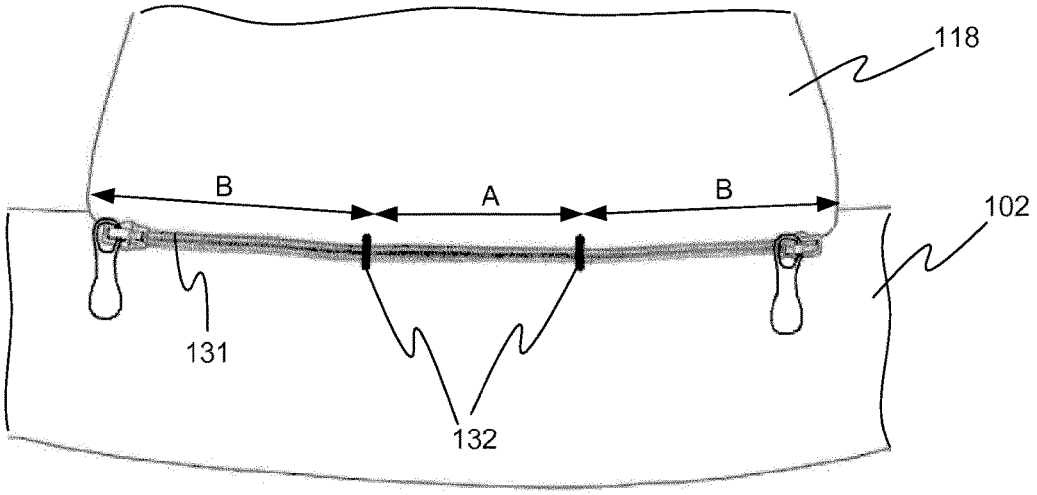
FIG. 12 is a fragmentary front view of an embodiment of the baby carrier in which leg openings are shown in a closed position.
Figure 13:
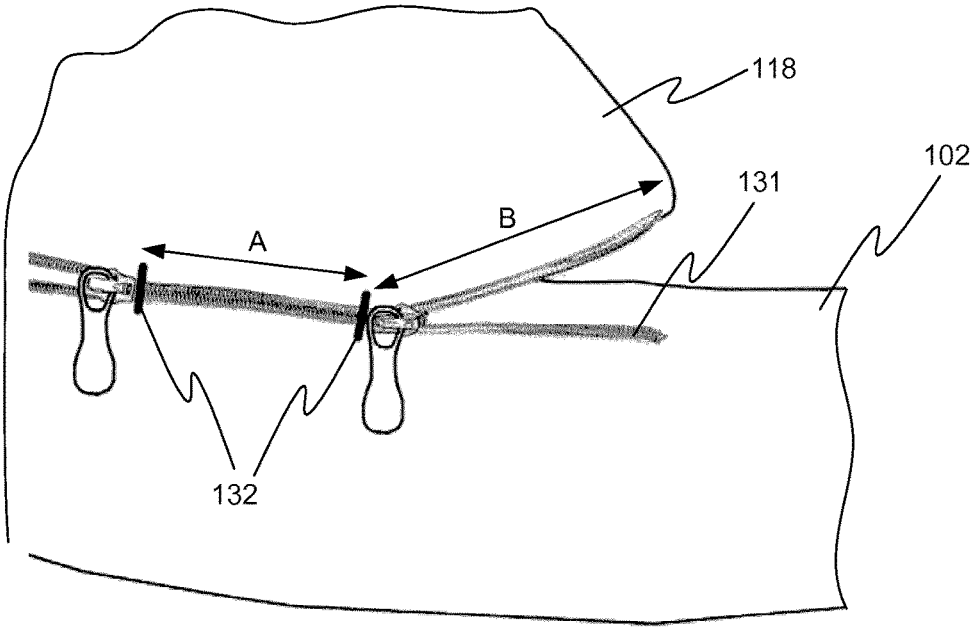
FIG. 13 is a view similar to FIG. 12, but with leg opening shown in an open position.

The zippers 111*a*, 111*b* may in another embodiment, as shown in FIGS. 12-13, be replaced by one zipper 131, extending over the entire intersection between the front portion 101, stomach portion 118 and waist strap 102. The zipper 131 is in this case openable from both directions. Further, it comprises two stops 132, located such that only parts of the zipper 131 can be opened. The stops 132 are located where the portions B meet the portion A. Thus, the single zipper 131 has the same effect and functionality as the two separate zippers 111*a*, 11*b*. It is desirable, in the production of the baby carrier 100, to use one single zipper 131 since it is easy to add.

In one embodiment, the height of the stomach portion 118 is approximately 20 cm. In other embodiments, it could instead be approximately 10 cm.

In an aspect, there is provided a baby carrier by which the baby can be carried in two main positions—the first position with the baby's chest towards the carrying person and a second position with the baby's back towards the carrying person. This switch between two main positions being accomplished by means of the carrier being provided with an at least partially detachable interface between the front portion, stomach portion and the waist strap.

It should be appreciated that the inventive concept is not limited to the embodiments here, and many modifications are feasible within the scope of the invention set forth in the appended claims.

The invention claimed is:

1. A baby carrier comprising a front portion, a stomach portion, a waist strap, and two shoulder straps, each shoulder strap comprising first and second end portions, wherein the first end portion of each shoulder strap is fixedly attached to the stomach portion and the second end portion is attached to the front portion, wherein the front portion and stomach portion are attached to the waist strap, and wherein the stomach portion and front portion in combination define leg supports having leg openings through which a child's legs can extend; said stomach and front portions being at least partly detachably attached to the waist strap along an interface between said waist strap and said stomach and front portions; whereby side portions of said interface are selectively moveable between (1) a first position in which said leg supports are connected to said waist strap along their respective lengths such that said leg openings face generally toward the stomach portion and (2) a second position in which said leg supports are at least partly detached from said waist strap such that the leg openings extend generally outwardly to support the child's legs in a sitting position whereby the child's legs extend through the leg openings and are at least in part directed forward when the child is facing away from the wearer.

2. The baby carrier according to claim 1, wherein a middle portion along both the front portion and stomach portion is fixedly attached to the waist strap.

3. The baby carrier according to claim 2, wherein the side portions are connected to the waist strap by one of the following fasteners: zippers, buttons, Velcro, press studs or hooks.

4. The baby carrier according to claim 2, wherein the side portions are attached to the waist strap by at least one zipper which is openable by one of a one-step maneuver by means of a common drawstring or two separate zipper pullers.

5. The baby carrier according to claim 1, wherein the intersection between the front portion and stomach portion and the waist strap comprises a zipper which is openable from two directions.

6. The baby carrier according to claim 5, wherein the zipper comprises two stops such that the leg openings extend along two side portions of both the front portion and stomach portion.

7. The baby carrier according to claim 1, further comprising a bottom portion fixedly attached to the front portion and detachably attached to the stomach portion, such that it is movable between at least two positions.

8. The baby carrier according to claim 7, wherein a first position of the bottom portion is a low position in which said bottom portion follows the outline of a lower part of the front portion and a lower part of the stomach portion, and wherein a second position of the bottom portion is a high position in which a distance is provided between the bottom portion and said front portion and stomach portion.

9. The baby carrier according to claim 1, further comprising two interstitial straps, each comprising a first end section and a second end section, wherein the first end sections are stitched to the front portion and the second end sections are detachably connected to the shoulder straps.

10. A method for adjusting a baby carrier according to claim 1 from a backward seating position into a forward seating position, the method comprising opening at least one zipper such that two side portions of the front portion and stomach portion are disengaged from the waist strap, providing the baby carrier with supports for a child's legs when sitting in a forward position.

11. The method for adjusting a baby carrier according to claim 10, wherein the at least one zipper is operated by means of a common drawstring.

12. The method for adjusting a baby carrier according to claim 10, wherein the at least one zipper is operated by means of two separate zipper pullers.

13. The baby carrier of claim 1, wherein the side portions of the interface are moved from the first to the second position together.

14. The baby carrier according to claim 1, wherein the second end portion of the shoulder strap is detachably attached to the front portion.

15. A baby carrier convertible between a first position in which a child in the carrier faces the wearer and a second position in which the child faces away from the wearer; the baby carrier comprising:

a front portion, a stomach portion, and opposed leg supports at a bottom of the front and stomach portions; said leg supports defining leg openings through which the child's legs can extend;

a pair of shoulder straps connected between the front portion and stomach portion to enable the baby carrier to be worn; and a waist belt; said front and stomach portions and said leg supports being connected to the waist belt along an interface; at least the leg supports being removably connected to the waist belt whereby the leg supports are each movable between (1) a first position in which said leg supports are connected to said waist belt along their respective lengths such that said leg openings face generally toward the stomach portion and (2) a second position in which said leg supports are at least partly detached from said waist belt such that the leg openings extend generally outwardly to support the child's legs in a sitting position whereby the child's legs extend through the openings and are at least in part directed forward when the child is facing away from the wearer.

16. The baby carrier according to claim 15, wherein the leg supports are defined by the front portion and stomach portion.

* * * * *